US009610599B2

(12) United States Patent
Holzmann

(10) Patent No.: US 9,610,599 B2
(45) Date of Patent: Apr. 4, 2017

(54) METERING DISPENSER

(76) Inventor: Werner Holzmann, Marktoberdorf (DE)

( * ) Notice: Subject to any disclaimer, the term of this patent is extended or adjusted under 35 U.S.C. 154(b) by 0 days.

(21) Appl. No.: 13/807,684

(22) PCT Filed: Jul. 1, 2011

(86) PCT No.: PCT/EP2011/003287

§ 371 (c)(1),
(2), (4) Date: Sep. 23, 2013

(87) PCT Pub. No.: WO2012/000682

PCT Pub. Date: Jan. 5, 2012

(65) Prior Publication Data

US 2014/0008396 A1 Jan. 9, 2014

(30) Foreign Application Priority Data

Jul. 1, 2010 (DE) ..... 20 2010 009 751 U

(51) Int. Cl.
*B65D 88/54* (2006.01)
*B05B 11/00* (2006.01)

(52) U.S. Cl.
CPC ..... *B05B 11/3025* (2013.01); *B05B 11/0064* (2013.01); *B05B 11/3046* (2013.01); *B05B 11/3016* (2013.01); *B05B 11/3023* (2013.01); *B05B 11/3084* (2013.01)

(58) Field of Classification Search
CPC ..... B05B 11/3025; B05B 11/3046; B05B 11/0064; B05B 11/3023; B05B 11/3016; B05B 11/3084
USPC ..... 222/321.7, 321.9
See application file for complete search history.

(56) References Cited

U.S. PATENT DOCUMENTS

| | | | | |
|---|---|---|---|---|
| 4,317,531 | A * | 3/1982 | Saito | B05B 11/3018 222/321.2 |
| 4,875,604 | A * | 10/1989 | Czech | 222/257 |
| 5,590,815 | A * | 1/1997 | Montaner et al. | 222/82 |
| 5,704,519 | A | 1/1998 | Crosnier et al. | |
| 7,654,418 | B2 * | 2/2010 | Law et al. | 222/259 |
| 7,775,461 | B2 * | 8/2010 | Laidler et al. | 239/362 |
| 7,854,355 | B2 * | 12/2010 | Rossignol | 222/380 |
| 2006/0071033 | A1 * | 4/2006 | Lewis | 222/321.9 |
| 2007/0084882 | A1 | 4/2007 | Rossignol | |

FOREIGN PATENT DOCUMENTS

EP 0753353 A2 1/1997

* cited by examiner

*Primary Examiner* — Frederick C Nicolas
(74) *Attorney, Agent, or Firm* — Price Heneveld LLP

(57) ABSTRACT

A cost-effective metering dispenser configured to allow at least one component accommodated in a container, in particular in cartridge form, to be metered by a pumping unit, having an inlet valve, an outlet valve and a pumping cylinder as well as a pumping piston, which is inserted in the pumping cylinder and can be activated by an actuating element. The dispenser is economical to produce because of the straightforward construction of the pumping unit, that can be arranged in a sleeve, which continues the container and is formed in one piece with the container.

8 Claims, 2 Drawing Sheets

METERING DISPENSER

AREA OF THE ART

The invention relates to a metering dispenser.

DESCRIPTION OF THE BACKGROUND

The prior art discloses such dispensers, wherein the mixing ratio of two components is continuously adjustable. Such a dispenser can be used, for example as a lip care dispenser to mix two components with different tints such that the color can be continuously adjusted over a wide range. The dimensions of such dispensers for these products are rather small such that a compact design of all components, especially of the pump unit is needed. Further, the dosage volume of these products is very small in comparison to the prior art. Moreover, these products are highly viscous, thus requiring a pump with a small "dead volume" and wide valve opening relative to the dosage volume. In order to achieve these requirements with a precise dosage, the valve must close very exactly and automatically to avoid product return. Furthermore, production cost should be low by using fewer parts and easy assembling.

In WO 00/09270, especially FIG. 3, the dispenser has two pumping units, each of which is associated with a replaceable cartridge, in which one type of sunscreen with very different sun protection factors is contained. This also applies to WO 03/092 905, which shows two pump units recessed on the upper side of each cartridge and being supported by cylindrical recesses in the housing. The pump units or the pump pistons are activated by an actuating element which is in communication with a pump or nozzle head being mounted in a housing of the dispenser and is operated by the consumer via a handle. These known dispensers are well-established in the market, but they still have disadvantages. In particular, the pump units and their support on the cartridge outlet have a rather complicated structure.

SUMMARY OF THE INVENTION

Thus, the invention has the object to provide a dispenser having at least a structurally simpler and more reliable pump unit.

In comparison to the above-described dispensers the inventive solution has a particularly simple and stable structure, as the pump unit is guided in the upper portion of the cartridge or the container in a sleeve. By this sleeve in continuation with the cartridge the component to be metered can easily pass the inlet and outlet valve of the pump unit. Further, this arrangement allows to stabilize the guide of the pump piston or the support of the pump cylinder and to reduce the number of moving components. Preferably, the pump unit is made as a one-piece injection-molded part.

It is particularly advantageous that the pump piston or pump cylinder of each pump unit can be mounted to the sleeve on the container very easily and having a solid construction with low height. Preferably, the sleeve is integrally formed on the container by injection molding. In addition, the sleeve includes in its interior ring beads or undercuts for latching with the pump cylinder and/or the pump piston. Thus, the pump cylinder is securely anchored in the sleeve or pressed-in, so that the bottom of the pump cylinder can securely fix or clamp an inlet valve, in particular in the form of a membrane.

Particularly important is the design of the spring for the outlet valve, which is arranged on a fold-down spring clip, wherein the latter is preferably connected to the pump piston in one piece by injection molding. Here, the spring clip has a film hinge and opposite thereto a locking pin, so that a simple, cost-effective manufacture and assembly is obtained. Here, the spring may also consist of plastic and is integrally formed in a meander shape on molding of the spring clip, so that a very simple structure is achieved.

BRIEF DESCRIPTION OF THE FIGURES

Hereinafter, preferred embodiments of the invention are explained in detail with reference to the drawings. They show in.

DETAILED DESCRIPTION OF THE INVENTION

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved metering dispenser.

Figure 1:
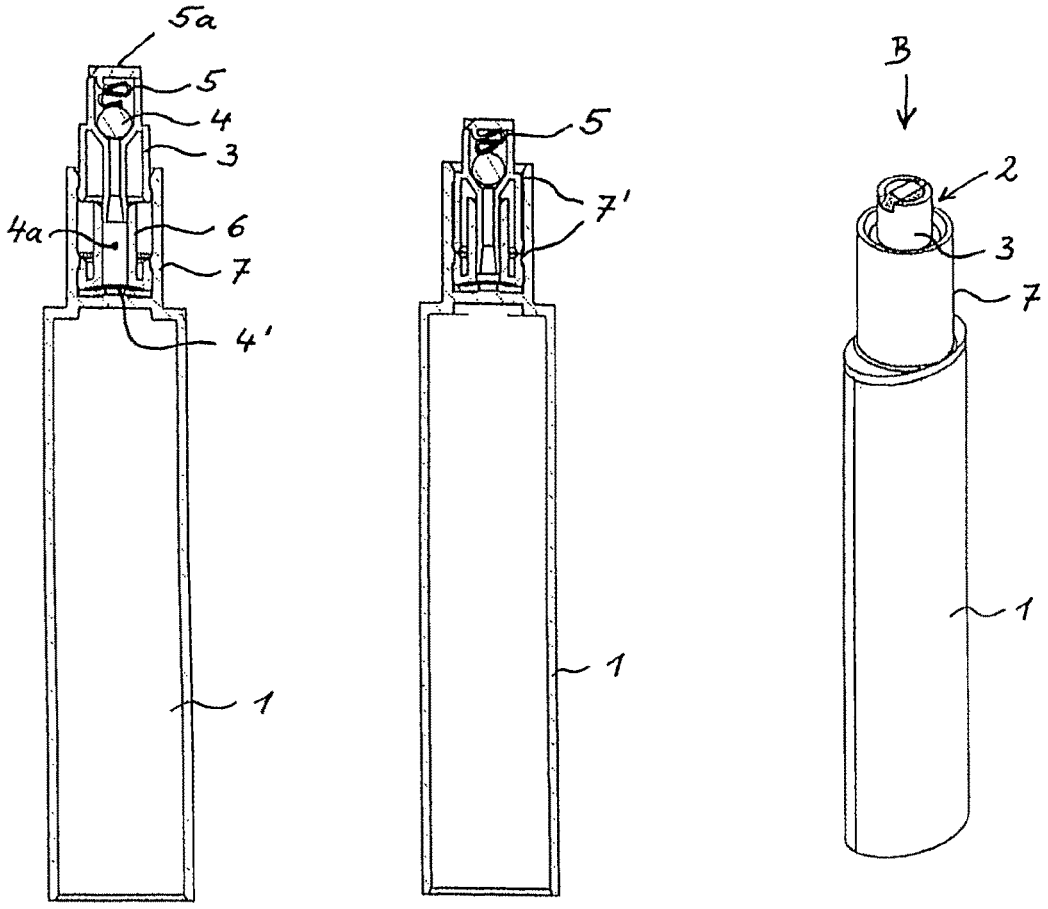
FIG. 1 a container a metering dispenser with a pump unit (three views)

With reference to the perspective view in FIG. 1, the basic concept of a metering dispenser is described, which consists of a container 1, here a cartridge with oval or semicircular shape, and a pump unit 2. In a dispenser, two or more of such containers 1 may be provided, each with a respectively associated pump unit. Advantageously, adjustment of the mixture of the individual components in the containers 1 can be carried out by turning a non-illustrated actuator. In many applications, however, a fixed setting of the mixing ratio is sufficient. The output of the component from the respective container 1 is effected by pressure on the pump piston 3 of the pump unit 2 via an actuator B, as is indicated only schematically. The pump piston 3 acts along with a pump cylinder 6, as shown in sectional views in FIG. 1 and shown enlarged in FIG. 3. This so-called pressure-suction pump unit 2 is inserted in a sleeve 7, which continues the container 1 at the top. In a favorable manufacturing the sleeve 7 is injection-molded together with the container 1, so that a stable, integral construction is obtained. In the annular space between the inside of the sleeve 7 and the outer periphery of the pump cylinder 6 a coil spring for returning the pump plunger 3 can be easily inserted.

In the left section of FIG. 1 the pump piston 3 is shown in a non-operated state, while in the central representation the pump plunger 3 is pressed-down in the pump cylinder 6. Thus, the volume of the pump chamber 4*a* is reduced, so that an inlet valve 4' opens and in consequence the component is sucked-out of the container 1 and a spring-loaded outlet valve 4 opens. This one is formed by a ball, which is depressed by a spring 5 towards an associated valve seat in the pump piston 3. The pump piston 3 and the pump cylinder 6 are held within the sleeve 7 by circumferential beads 7', by latching these components with corresponding gradations (see for example, FIGS. 2 and 3) on the pump cylinder 6 and pump piston 3, locked in the sleeve 7. Thus, the pump cylinder 6, preferably formed of elastic plastic, is fixed in the sleeve 7 in a sealing manner or pressed-in, such that the bottom or underside of the pump cylinder 6 clamps the inlet valve 4', being particularly shaped as a membrane (see for example, FIG. 3, right perspective view).

Figure 2:
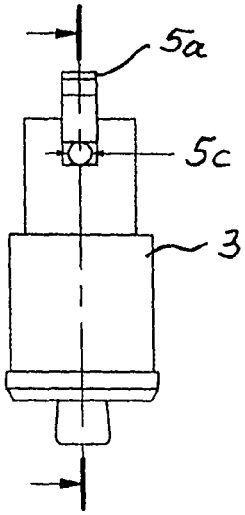
FIG. 2 an embodiment of a pump piston (three views)
Figure 2:
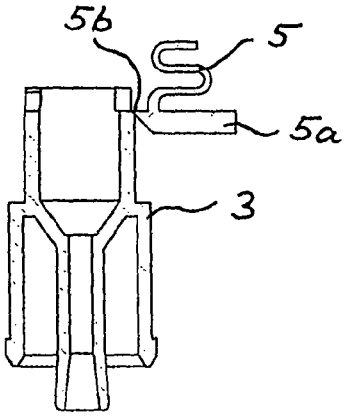
Figure 2:
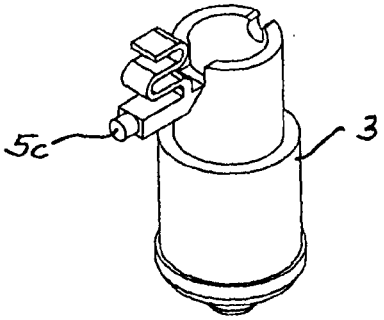

FIG. 2 shows the pump piston 3 in a side view, a cross-section, and a perspective view. This illustrates the structure of the outlet valve 4 and the associated spring 5, which is arranged on a spring clip 5*a*, being preferably injection-molded in one piece with the pump piston 3. Therein the spring clip 5*a* can include a film hinge 5*b* to be folded and locking pin 5*c* at the opposite side for locking at the wall of the pump piston 3. As can be seen, the plastic spring 5 is preferably formed in a meander shape on the spring clip 5*a* by injection-molding, so that a bias effect results and the spring 5 blocks upon actuation of the pump unit 2.

Figure 3:
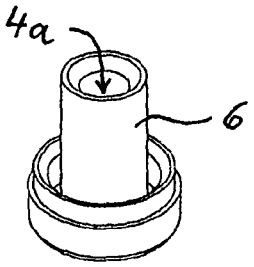
FIG. 3 a detailed view of a pump cylinder in two perspective views.
Figure 3:
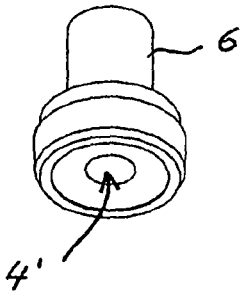

In FIG. 3, the pump cylinder 6 is shown in perspective views from above and from below. As can be seen, the latter has a pump chamber 4*a* and on the outer periphery a collar design to seal the pump unit 2 relative to the sleeve 7 and the container 1, in particular during actuation of the pump piston 3, immersing into the pump chamber 4*a*. Of course, in this case the non-illustrated component is conveyed from the container 1 to an outlet nozzle. As indicated above, the dispenser might include a plurality of such containers 1 with respective pump units 2, so that in a center position of a control element, the two pump units have identical strokes or delivery volumes of 50% of the total discharge amount, each. In this case, the mixture contains equal parts of the two (or more) components of the two containers. At appropriate intermediate positions of the control element and thus corresponding discharge volumes, each component can be continuously varied between 0% and 100%. The container 1 can be formed in the manner of a bottle or a bag and might have different cross-sections.

Here, the compact design of the described elements is important as especially the pump unit 2 is integrated into the sleeve 7 and preferably manufactured by injection-molding in an inexpensive manner, as well as detent or snap connections for easy assembling. Thus, the dispenser together with suitable containers 1, especially in the form of an oval cartridge as shown in FIG. 1, can be used for various materials, such as cosmetics. The pump unit can be also be used as a single dispenser or an adjustable two-component dispenser for highly viscous products with low dosage, such as shaving gel, two-component silicone (adhesive gel) or glue.

The following claims are thus to be understood to include what is specifically illustrated and described above, what is conceptually equivalent, what can be obviously substituted and also what essentially incorporates the essential idea of the invention. Those skilled in the art will appreciate that various adaptations and modifications of the just-described preferred embodiment can be configured without departing from the scope of the invention. The illustrated embodiment has been set forth only for the purposes of example and that should not be taken as limiting the invention. Therefore, it is to be understood that, within the scope of the appended claims, the invention may be practiced other than as specifically described herein.

What is claimed is:

1. A dispenser for metering of at least one component, the dispenser comprising:

a container accommodating the at least one component; and a pump unit comprising:

an inlet valve;

an outlet valve;

a pump cylinder; and a pump piston inserted in the pump cylinder and activated by an actuating element;

wherein the pump piston is formed as a single piece and the pump unit is inserted into a sleeve continuing the container and being integrally formed on the container with a portion of the pump piston contacting and being guided by an inner surface of the sleeve;

wherein the sleeve includes in an interior of the sleeve at least one undercut or bead for latching with the pump cylinder and the pump piston;

wherein the pump cylinder is pressed into the sleeve in a sealed manner and clamps with an underside of the pump cylinder to the inlet valve; and wherein the outlet valve is biased by a spring.

2. The dispenser according to claim 1, wherein the spring is disposed on a spring clip and is formed with the pump piston in one piece via the hinge as well as a locking pin at the opposite side thereof.

3. The dispenser according to claim 1, wherein the pump piston is guided in the pump chamber.

4. The dispenser according to claim 1, wherein the container is in the form of a cartridge.

5. A dispenser for metering of at least one component, the dispenser comprising:

a container accommodating the at least one component; and a pump unit comprising:

an inlet valve;

an outlet valve;

a pump cylinder; and a pump piston inserted in the pump cylinder and activated by an actuating element;

wherein the pump piston is formed as a single piece and the pump unit is inserted into a sleeve continuing the container and being integrally formed on the container with a portion of the pump piston contacting and being guided by an inner surface of the sleeve;

wherein the sleeve includes in an interior of the sleeve at least one undercut or bead for latching with the pump cylinder and the pump piston;

wherein the pump cylinder is pressed into the sleeve in a sealed manner and clamps with an underside of the pump cylinder to the net valve; and wherein the outlet valve is biased by a spring; and wherein the outlet valve is formed as a ball valve.

6. A dispenser for metering of at least one component, the dispenser comprising:

a container accommodating the at least one component; and a pump unit comprising:

an inlet valve;

an outlet valve;

a pump cylinder; and a pump piston inserted in the pump cylinder and activated by an actuating element;

wherein the pump piston is formed as a single piece and the pump unit is inserted into a sleeve continuing the container and being integrally formed on the container with a portion of the pump piston contacting and being guided by an inner surface of the sleeve;

wherein the sleeve includes in an interior of the sleeve at least one undercut or bead for latching with the pump cylinder and the pump piston;

wherein the pump cylinder is pressed into the sleeve in a sealed manner and clamps with an underside of the pump cylinder to the inlet valve; and wherein the outlet valve is biased by a spring; and wherein the inlet and the outlet valves are self-closing valves that open to pressure.

7. A dispenser for metering of at least one component, the dispenser comprising:

a container accommodating the at least one component; and a pump unit comprising:

an inlet valve;

an outlet valve;

a pump cylinder; and a pump piston inserted in the pump cylinder and activated by an actuating element;

wherein the pump piston is formed as a single piece and the pump unit is inserted into a sleeve continuing the container and being integrally formed on the container with a portion of the pump piston contacting and being guided by an inner surface of the sleeve;

wherein the sleeve includes in an interior of the sleeve at least one undercut or bead for latching with the pump cylinder and the pump piston;

wherein the pump cylinder is pressed into the sleeve in a sealed manner and clamps with an underside of the pump cylinder to the net valve; and wherein the outlet valve is biased by a spring; and wherein a return spring for returning the pump piston is guided between the sleeve and the pump cylinder, outside of a flow of the component.

8. A dispenser for metering of at least one component, the dispenser comprising:

a container accommodating the at least one component; and a pump unit comprising:

an inlet valve;

an outlet valve;

a pump cylinder; and a pump piston inserted in the pump cylinder and activated by an actuating element;

wherein the pump piston is formed as a single piece and the pump unit is inserted into a sleeve continuing the container and being integrally formed on the container with a portion of the pump piston contracting and being guided by an inner surface of the sleeve;

wherein the sleeve includes in an interior of the sleeve at least one undercut or bead for latching with the pump cylinder and the pump piston;

wherein the pump cylinder is pressed into the sleeve in a sealed manner and clamps with an underside of the pump cylinder to the inlet valve; and wherein the outlet valve is biased by a spring; and wherein the inlet valve is in the form of a membrane.

* * * * *